US010323883B2

(12) United States Patent
Zhang et al.

(10) Patent No.: US 10,323,883 B2
(45) Date of Patent: Jun. 18, 2019

(54) HEAT EXCHANGE PLATE FOR PLATE-TYPE HEAT EXCHANGER AND PLATE-TYPE HEAT EXCHANGER PROVIDED WITH SAID HEAT EXCHANGE PLATE

(71) Applicant: Danfoss Micro Channel Heat Exchanger (Jiaxing) Co., Ltd., Zhejiang (CN)

(72) Inventors: Zhifeng Zhang, Zhejiang (CN); Wenjian Wei, Zhejiang (CN)

(73) Assignee: Danfoss Micro Channel Heat Exchanger (Jiaxing) Co., Ltd., Haiyan, Zhejiang (CN)

( * ) Notice: Subject to any disclaimer, the term of this patent is extended or adjusted under 35 U.S.C. 154(b) by 172 days.

(21) Appl. No.: 15/122,255

(22) PCT Filed: Mar. 5, 2015

(86) PCT No.: PCT/CN2015/073690

§ 371 (c)(1),
(2) Date: Oct. 6, 2016

(87) PCT Pub. No.: WO2015/131834

PCT Pub. Date: Sep. 11, 2015

(65) Prior Publication Data

US 2017/0016680 A1 Jan. 19, 2017

(30) Foreign Application Priority Data

Mar. 7, 2014 (CN) ..... 2014 1 0083866

(51) Int. Cl.

| | |
|---|---|
| ***F28D 9/00*** | (2006.01) |
| ***F28F 3/04*** | (2006.01) |
| ***F28F 9/02*** | (2006.01) |

(52) U.S. Cl.
CPC ..... *F28D 9/0043* (2013.01); *F28F 3/042* (2013.01); *F28F 9/026* (2013.01)

(58) Field of Classification Search
CPC .. F28F 3/044; F28F 3/046; F28F 3/048; F28F 3/086; F28F 2250/04; F28F 3/042;
(Continued)

(56) References Cited

U.S. PATENT DOCUMENTS 2,550,339 A * 4/1951 Ehrman ..... F28F 3/046 165/167
2,699,324 A 1/1955 Goodman
(Continued)

FOREIGN PATENT DOCUMENTS

CN 1748119 A 3/2006
CN 1811322 A 8/2006
(Continued)

OTHER PUBLICATIONS

International Search Report for PCT Serial No. PCT/CN2015/073690 dated Jun. 10, 2015.
(Continued)

*Primary Examiner* — Jianying C Atkisson
*Assistant Examiner* — Jose O Class-Quinones
(74) *Attorney, Agent, or Firm* — McCormick, Paulding & Huber LLP

(57) ABSTRACT

A heat exchange plate for a plate-type heat exchanger and a plate-type heat exchanger provided with said heat exchange plate. The heat exchange plate includes an opening used to form an end opening, a plurality of protrusions arranged around at least a portion of the opening along a circular line along the opening, the plurality of protrusions protruding towards one side of a plate plane; transition portions arranged between at least two neighbouring protrusions, the transition portions being located on one side of the plate
(Continued)

plane, and being a preset distance from the plate plane. The distance from the tops of the protrusions to the plate plane is greater than the distance from the lowest points of the transition portions to the plate plane.

17 Claims, 4 Drawing Sheets

(58) Field of Classification Search
CPC ..... F28F 9/026; F28D 1/03; F28D 9/0043; F28D 9/005; F28D 9/0081; F28D 9/0012; F28D 9/0018; F28D 9/0031; F28D 9/0037; F28D 9/0056
See application file for complete search history.

(56) References Cited

U.S. PATENT DOCUMENTS

| | | | | |
|---|---|---|---|---|
| 3,775,234 | A | 11/1973 | Rich | |
| 3,807,496 | A | 4/1974 | Stadmark | |
| 5,443,115 | A * | 8/1995 | Pedersen | F28F 3/083 165/167 |
| 5,474,662 | A * | 12/1995 | Miyamae | C02F 1/4618 204/257 |
| 6,070,658 | A * | 6/2000 | Cipriani | F28F 3/10 165/166 |
| 6,681,844 | B1 | 1/2004 | Inoue et al. | |
| 7,424,908 | B2 | 9/2008 | Blomgren | |
| 7,857,039 | B2 * | 12/2010 | Nakamura | F28D 9/0025 165/157 |
| 2001/0030043 | A1 * | 10/2001 | Gleisle | B23K 1/0012 165/167 |
| 2005/0082049 | A1 * | 4/2005 | Brost | F28D 9/005 165/166 |
| 2007/0006998 | A1 | 1/2007 | Brost | |
| 2009/0194267 | A1 | 8/2009 | Gustafsson | |
| 2009/0229803 | A1 * | 9/2009 | Lin | F28D 1/0325 165/167 |
| 2011/0088882 | A1 * | 4/2011 | Persson | F28D 9/005 165/167 |
| 2011/0240273 | A1 * | 10/2011 | Blomgren | F28F 3/083 165/168 |
| 2012/0118548 | A1 | 5/2012 | Han et al. | |

FOREIGN PATENT DOCUMENTS

| | | | | |
|---|---|---|---|---|
| CN | 200946997 | Y | 9/2007 | |
| CN | 101158561 | A | 4/2008 | |
| CN | 101178293 | A | 5/2008 | |
| CN | 201355211 | Y | 12/2009 | |
| CN | 202057231 | U | 11/2011 | |
| CN | 103791758 | A | 5/2014 | |
| CN | 103791759 | A | 5/2014 | |
| DE | 19917761 | C1 | 1/2001 | |
| JP | H08271180 | A | 10/1996 | |
| JP | H11311491 | A | 11/1999 | |
| JP | 1083398 | A1 * | 3/2001 | F28D 1/0333 |
| JP | 2011516816 | A | 5/2011 | |
| KR | 100950689 | B1 | 3/2010 | |
| WO | 8809473 | A1 | 12/1988 | |
| WO | 9500810 | A1 | 1/1995 | |
| WO | 2004072570 | A1 | 8/2004 | |
| WO | 2005088223 | A1 | 9/2005 | |
| WO | 2010090557 | A1 | 8/2010 | |

OTHER PUBLICATIONS

International Search Report for Serial No. PCT/CN2015/073007 dated Apr. 20, 2015.
Supplementary European Search Report for Serial No. EP 15 75 8798 dated Oct. 13, 2017.
Notice of the Reason for Refusal and English Translation for Serial No. 2016-553814 dated Jan. 22, 2019.
Supplementary European Search Report for Serial No. EP 15 75 7662 dated Nov. 7, 2017.

* cited by examiner

Prior Art

Prior Art

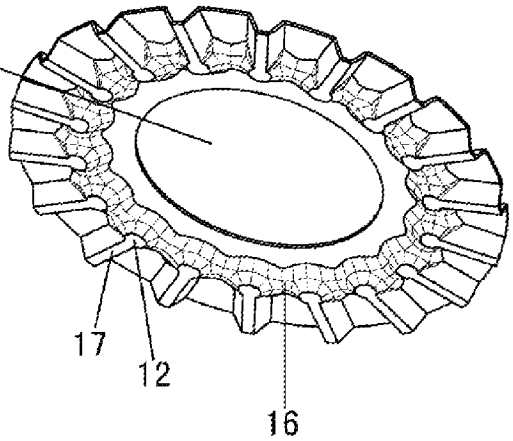
Fig. 15
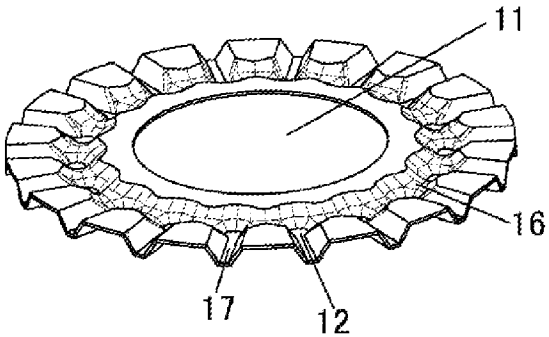
Fig. 16
Fig. 13
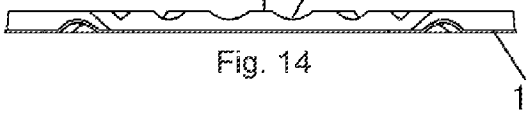
Fig. 14
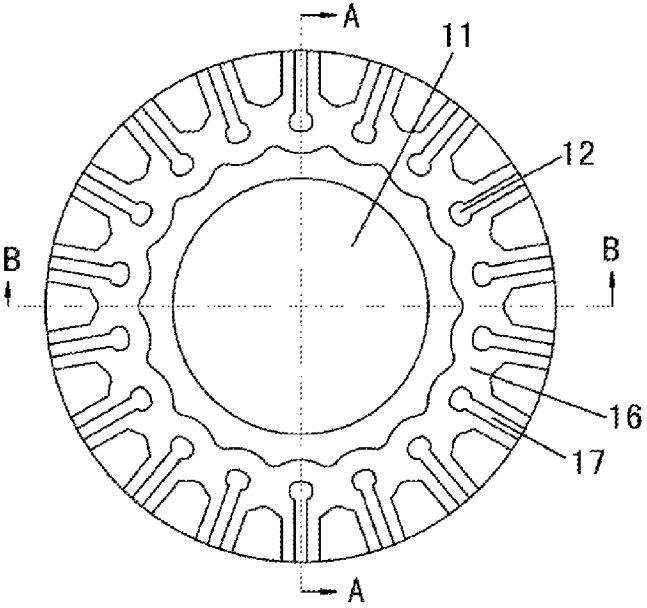
Fig. 12

HEAT EXCHANGE PLATE FOR PLATE-TYPE HEAT EXCHANGER AND PLATE-TYPE HEAT EXCHANGER PROVIDED WITH SAID HEAT EXCHANGE PLATE

CROSS-REFERENCE TO RELATED APPLICATIONS

This application is entitled to the benefit of and incorporates by reference subject matter disclosed in the International Patent Application No. PCT/CN2015/073690 filed on Mar. 5, 2015 and Chinese Patent Application 201410083866.3 filed Mar. 7, 2014.

TECHNICAL FIELD

The present invention relates to a heat exchanger, in particular a heat exchange plate for a plate-type heat exchanger and a plate-type heat exchanger provided with said heat exchange plate.

BACKGROUND ART

In the prior art, as FIGS. 1 to 4 show, a raised pattern is provided around ports 11 (fluid inlet and fluid outlet) of a heat exchange plate of a plate-type heat exchanger, to increase the strength of the plate-type heat exchanger and cause a larger pressure drop between the port 11 and a fluid channel, and thereby achieve better fluid distribution between fluid channels. With regard to the structural design of existing products, since the strength is low, it is necessary to make the plates relatively thick to increase strength, so costs are high.

As FIG. 1 shows, existing raised patterns include a spider's web design, but such a raised pattern has low strength under certain conditions, and the layout is determined by a fish bone pattern of a heat exchange part.

As FIG. 2 shows, the raised pattern shown in FIG. 2 is not limited by the pattern of the heat exchange part, but the protrusions are independent, so in certain situations, strength is low.

The raised pattern shown in FIG. 3 is formed by cutting away a part of long protrusions; this raised pattern has low strength, and poor manufacturability.

In addition, when the raised pattern formed by long protrusions shown in FIG. 4 is employed, the strength of the plate-type heat exchanger is low, and stresses are not borne uniformly.

In the various types of structure above, there must be a section of plane flush with a basic plane between every two adjacent protrusions, i.e. a transitional part between two adjacent protrusion points is a lower plane. As a result, the distance between every two protrusions cannot be too small, so strength is limited and restrictions are increased.

SUMMARY

An object of the present invention is to provide a heat exchange plate for a plate-type heat exchanger and a plate-type heat exchanger having the heat exchange plate, wherein the heat exchange plate and the plate-type heat exchanger have high strength, and the plates can be reduced in thickness to save costs.

Another object of the present invention is to provide a heat exchange plate for a plate-type heat exchanger and a plate-type heat exchanger having the heat exchange plate, wherein higher pressure-bearing strength and a better solution are provided in the case where a high-pressure coolant such as carbon dioxide is used.

According to one aspect of the present invention, the present invention provides a heat exchange plate for a plate-type heat exchanger, the heat exchange plate comprising: an opening for forming a port; multiple protrusions arranged around at least a part of the opening along an annular line surrounding the opening, the multiple protrusions projecting to one side of the plate plane; transitional parts disposed between at least two adjacent protrusions, the transitional parts being located on said side of the plate plane at a predetermined distance from the plate plane, and the distance from the top of the protrusion to the plate plane being greater than the distance from the lowest point of the transitional part to the plate plane.

According to one aspect of the present invention, the top of the protrusion is substantially flat.

According to one aspect of the present invention, the distance from the top of the protrusion to the lowest point of the transitional part is less than or equal to the distance from the lowest point of the transitional part to the plate plane.

According to one aspect of the present invention, the protrusions are connected via corresponding transitional parts, and together with the transitional parts form an entire ridge.

According to one aspect of the present invention, the heat exchange plate for a plate-type heat exchanger also comprises: a coupling part located in the plate plane between at least two adjacent protrusions.

According to one aspect of the present invention, the dimension of the top of the protrusion in the circumferential direction of the annular line is greater than a radial dimension.

According to one aspect of the present invention, the top of the protrusion is an elongated part extending in the circumferential direction of the annular line.

According to one aspect of the present invention, the transitional parts have the shape of a curved surface.

According to one aspect of the present invention, the transitional parts project to another side, opposite said side, of the plate plane, relative to the tops of adjacent protrusions.

According to one aspect of the present invention, the protrusions are connected via corresponding transitional parts, and together with the transitional parts form an entire annular ridge.

According to one aspect of the present invention, a protrusion or protrusions in at least a first region differ(s) in size, shape and/or spacing from a protrusion or protrusions in a second region.

According to one aspect of the present invention, the heat exchange plate for a plate-type heat exchanger also comprises: a channel ridge which extends from at least one protrusion in a direction away from the opening and is used for forming a fluid channel.

According to one aspect of the present invention, the top of the at least one protrusion and the top of the channel ridge are substantially in the same plane.

According to another aspect of the present invention, the present invention provides a plate-type heat exchanger, comprising the heat exchange plate described above.

Compared with plate-type heat exchangers having the raised patterns shown in FIGS. 1, 3 and 4, the plate-type heat exchanger according to the present invention has higher strength. The plate-type heat exchanger according to the present invention has good resistance to freezing, e.g. if one protrusion leaks, fluid can diffuse to other protrusions, to avoid immediate freezing.

In addition, compared with a plate-type heat exchanger provided with an additional apparatus as a substitute for a raised pattern, the plate-type heat exchanger according to the present invention has lower manufacturing costs and material costs.

Furthermore, the number of protrusions in the raised pattern surrounding the ports in the plate-type heat exchanger according to the present invention is not limited by the space around the ports; it may be set according to pressure drop requirements and need not be set according to space.

BRIEF DESCRIPTION OF THE DRAWINGS

FIG. 12 is a schematic main view of a raised pattern around a port of a heat exchange plate for a plate-type heat exchanger according to an embodiment of the present invention;

FIG. 13 is a schematic sectional view along line AA in FIG. 12 of a raised pattern around a port of a heat exchange plate for a plate-type heat exchanger according to an embodiment of the present invention;

FIG. 14 is a schematic sectional view along line BB in FIG. 6 of a raised pattern around a port of a heat exchange plate for a plate-type heat exchanger according to an embodiment of the present invention;

FIG. 15 is a schematic perspective view of a raised pattern around a port of a heat exchange plate for a plate-type heat exchanger according to an embodiment of the present invention, wherein one side of the heat exchange plate is shown; and FIG. 16 is a schematic perspective view of a raised pattern around a port of a heat exchange plate for a plate-type heat exchanger according to an embodiment of the present invention, wherein another side of the heat exchange plate is shown.

DETAILED DESCRIPTION

Figure 1:
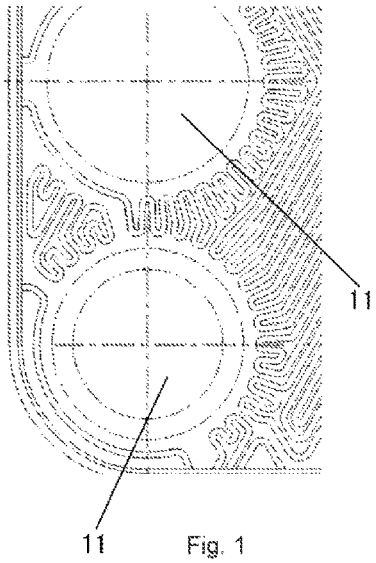
FIGS. 1 to 4 are schematic diagrams of a raised pattern around a port of an existing heat exchange plate.
Figure 2:
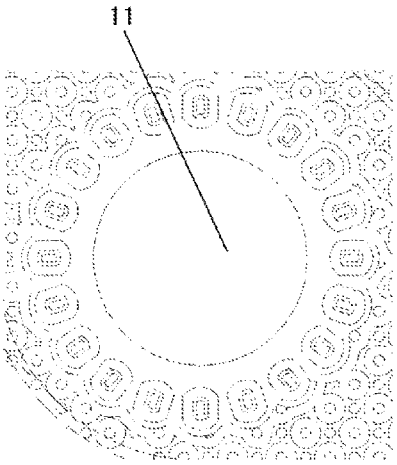
Fig. 2 Prior Art
Figure 3:
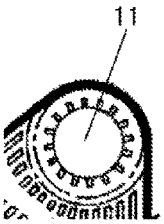
Figure 4:
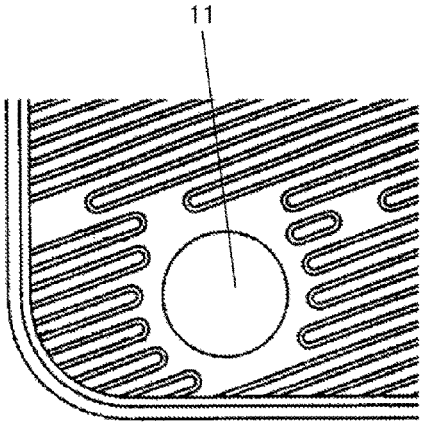
Prior Art Fig. 4
Figure 5:
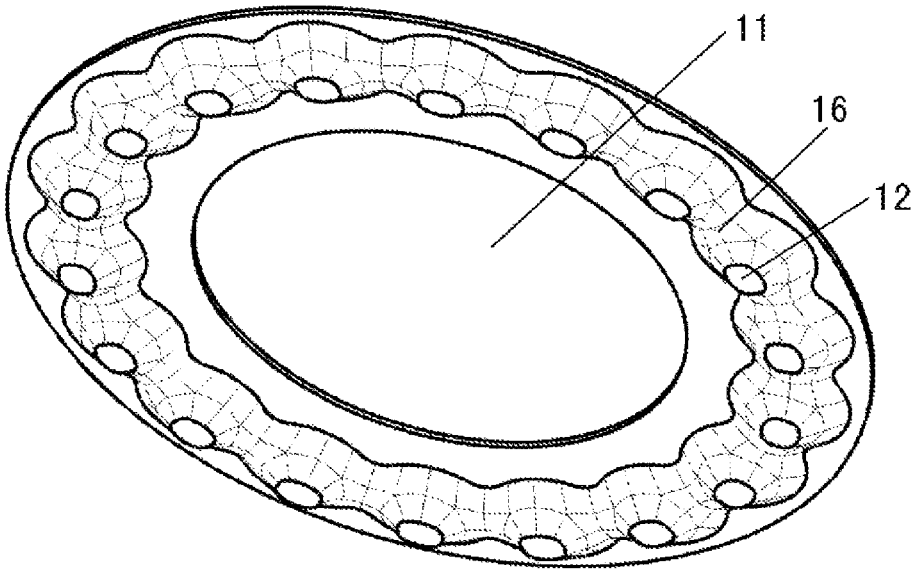
FIG. 5 is a schematic perspective view of a raised pattern around a port of a heat exchange plate for a plate-type heat exchanger according to an embodiment of the present invention.
Figure 8:
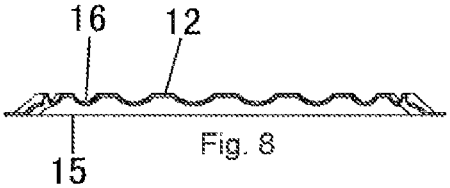
FIG. 8 is a schematic sectional view along line BB in FIG. 6 of a raised pattern around a port of a heat exchange plate for a plate-type heat exchanger according to an embodiment of the present invention.
Figure 6:
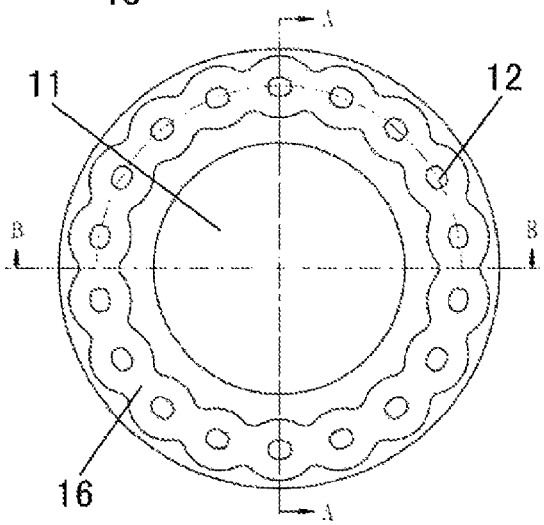
FIG. 6 is a schematic main view of a raised pattern around a port of a heat exchange plate for a plate-type heat exchanger according to an embodiment of the present invention.
Figure 7:
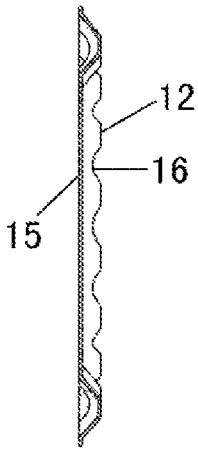
FIG. 7 is a schematic sectional view along line AA in FIG. 6 of a raised pattern around a port of a heat exchange plate for a plate-type heat exchanger according to an embodiment of the present invention.

The present invention is explained further below in conjunction with the accompanying drawings and particular embodiments.

A plate-type heat exchanger according to an embodiment of the present invention comprises: end plates and heat exchange plates which at least form a first heat exchange fluid channel and a second heat exchange fluid channel. The end plates are disposed on outer sides of the heat exchange plates. The plate-type heat exchanger also comprises: a fluid inlet and a fluid outlet as ports. The heat exchange plates are stacked together, thereby forming a first heat exchange fluid channel and a second heat exchange fluid channel alternately in a stacking direction. The plate-type heat exchanger may be any known plate-type heat exchanger. Heat exchange plates according to embodiments of the present invention are described in detail below.

Embodiment 1

FIGS. 5 to 8 show a raised pattern around a port of a heat exchange plate for a plate-type heat exchanger according to an embodiment of the present invention. The raised pattern is connected between the port 11 and a heat exchange fluid channel, and fluid enters the heat exchange fluid channel through the raised pattern. As FIGS. 5 to 8 show, the heat exchange plate for a plate-type heat exchanger according to an embodiment of the present invention comprises an opening 11 for forming the port and multiple protrusions 12 arranged around at least a part (all or part) of the opening 11 along an annular line (e.g. a circle) surrounding the opening 11; the multiple protrusions 12 project to one side of a plate plane 15. In an annular region which surrounds the opening 11 on that side of the annular line which is close to the opening 11 and in an annular region which surrounds the annular line or protrusions on that side remote from the opening 11, a plate part of the heat exchange plate may lie in the plate plane 15, or may partially lie in the plate plane 15. Since the protrusions 12 are formed by stamping a thin plate, the protrusions 12 have a hollow structure. The multiple protrusions 12 serve as welding parts or connecting parts of the heat exchange plate. The heat exchange plate also comprises transitional parts 16 between adjacent protrusions 12; the transitional parts 16 are located on said side of the plate plane 15, at a predetermined distance (greater than zero) from the plate plane. The plate plane 15 is the plane in which the heat exchange plate lies before being stamped. Due to the presence of transitional parts 16 between the protrusions 12, the protrusions 12 can be arranged densely, so the strength of the plate-type heat exchanger can be increased. In the figure, all adjacent protrusions 12 have transitional parts 16 therebetween; optionally, a transitional part 16 may be provided between at least two adjacent protrusions 12; the transitional part 16 may be a curved surface or a smooth curved surface. The protrusions 12 are connected via corresponding transitional parts 16, and together with the transitional parts 16 form an entire ridge, e.g. an annular ridge. The transitional parts 16 may have the shape of a curved surface. The transitional parts 16 project to another side (opposite said side) of the plate plane 15. That is, the transitional parts 16 project to another side (opposite said side) of the plate plane 15, relative to the tops of adjacent protrusions 12. Protrusions 12 in at least a first region or at least one protrusion 12 differ(s)

in size, shape and/or spacing from protrusions 12 in a second region or at least another protrusion 12, e.g. protrusions 12 may be arranged at equal or non-equal intervals around the ports 11.

Said side of a first heat exchange plate and said side of a second heat exchange plate are stacked together facing each other, with a first fluid channel being formed between the two heat exchange plates; another side (opposite said side) of the second heat exchange plate and another side (opposite said side) of a third heat exchange plate are stacked together facing each other, to form a second fluid channel. Heat exchange plates are stacked in sequence in this way to form the plate-type heat exchanger. The tops of the protrusions 12 of the two heat exchange plates forming the first fluid channel are welded or connected together; after flowing into the port, a first fluid enters the first fluid channel between the two heat exchange plates through gaps between the protrusions 12. The plate plane 15 on another side (opposite said side) of one heat exchange plate and the plate plane 15 on another side (opposite said side) of another plate are welded together, to form a sealed surface, so that the first fluid can only enter the first fluid channel, not the second fluid channel. A similar design is applied to the heat exchange plate in the vicinity of a second fluid inlet port, so as to ensure that a second fluid only enters the second fluid channel and cannot enter the first fluid channel. As FIGS. 5 to 8 show, the tops of the protrusions 12 may be substantially flat, e.g. may lie in a single plane.

Figure 9:
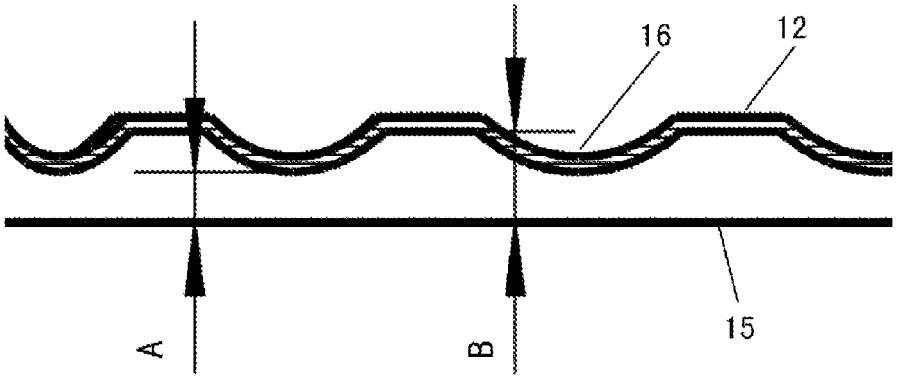
FIG. 9 is a partial enlarged schematic sectional view of a raised pattern around a port of a heat exchange plate for a plate-type heat exchanger according to an embodiment of the present invention.

FIG. 9 is a partial enlarged schematic sectional drawing of a raised pattern around a port of a heat exchange plate for a plate-type heat exchanger according to an embodiment of the present invention. As FIG. 9 shows, the distance B from the top of the protrusion 12 to the plate plane 15 is greater than the distance A from the lowest point of the transitional part 16 to the plate plane 15. The distance A may be greater than or equal to zero. The distance from the top of the protrusion 12 to the lowest point of the transitional part 16 may be less than or equal to the distance from the lowest point of the transitional part 16 to the plate plane 15.

Figure 10:
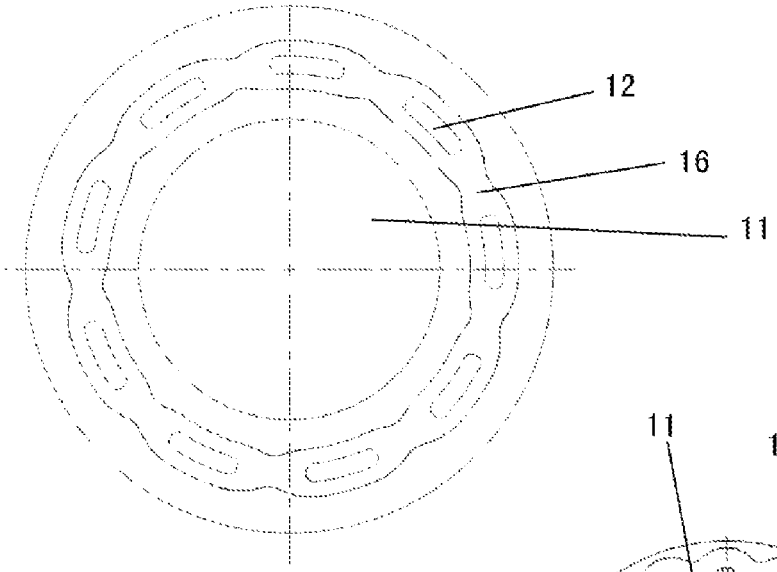
FIG. 10 is a schematic main view of a raised pattern around a port of a heat exchange plate for a plate-type heat exchanger according to an embodiment of the present invention wherein the top of the protrusion is elongated.

FIG. 10 shows an example of a raised pattern around a port of a heat exchange plate for a plate-type heat exchanger according to an embodiment of the present invention. As FIG. 10 shows, the dimension of the top of the protrusion 12 in the circumferential direction of the annular line may be greater than a radial dimension. For example, the top of the protrusion 12 is an elongated part extending in the circumferential direction of the annular line. For this reason the number of protrusions 12 is smaller, but the strength of the plate-type heat exchanger is higher.

Figure 11:
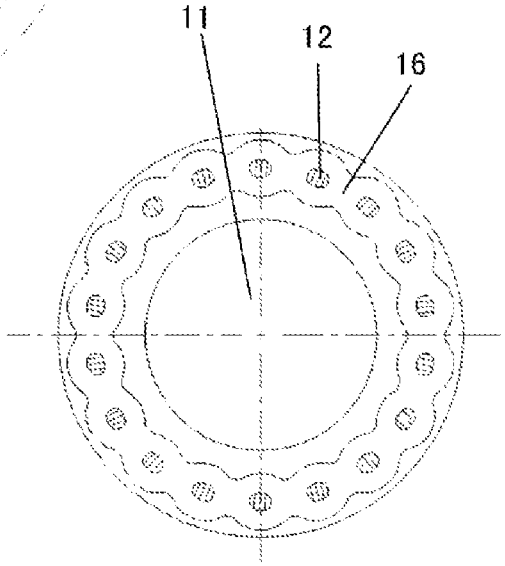
FIG. 11 is a schematic main view of a raised pattern around a port of a heat exchange plate for a plate-type heat exchanger according to an embodiment of the present invention wherein the top of the protrusion is shown as a welding part.

FIG. 11 shows a raised pattern around a port 11 of a heat exchange plate for a plate-type heat exchanger according to an embodiment of the present invention, wherein the shaded lines indicate the tops of the protrusions 12, i.e. welding parts or connecting parts. The larger the welding parts or connecting parts, the higher the strength of that part of the heat exchange plate of the plate-type heat exchanger which surrounds the end, and the larger the cross section of the raised pattern or pressure drop of fluid passing through the raised pattern.

According to an embodiment of the present invention, the number and form of the protrusions 12 may be adjusted as required, to achieve suitable strength and pressure drop, and the protrusions 12 may be disposed very densely, in order to achieve higher strength.

Optionally, a coupling part located in the plate plane may be disposed between at least two adjacent protrusions 12.

Embodiment 2

FIGS. 12 to 16 show a raised pattern around a port of a heat exchange plate for a plate-type heat exchanger according to another embodiment of the present invention. This embodiment differs from the embodiment described above in that channel ridges 17 have been added. That is, the heat exchange plate also comprises a channel ridge 17 which extends from at least one protrusion 12 in a direction away from the opening 11 and is used for forming a fluid channel. The fluid channel formed may serve as part of a heat exchange channel or be connected to a heat exchange channel of a heat exchange region. In the figures, all the protrusions 12 are provided with a channel ridge 17, but optionally, just one or more protrusions 12 may be provided with a channel ridge 17; the width of the protrusion 12 is larger than the width of the ridge 17, but optionally, the width of the protrusion 12 may be equal to or smaller than the width of the ridge 17. The top of at least one protrusion 12 may be in substantially the same plane as the top of the channel ridge 17. Optionally, the top of at least one protrusion 12 may not be in the same plane as the top of the channel ridge 17.

It must be explained that one or more features in the embodiments above may be combined to form new embodiments.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A heat exchange plate for a plate-type heat exchanger, the heat exchange plate comprising:

an opening for forming a port;

multiple protrusions arranged around the opening along an annular line surrounding the opening, the multiple protrusions projecting to one side of a plate plane;

transitional parts disposed between at least two adjacent protrusions along the annular line, wherein the protrusions are connected via corresponding transitional parts, and together with the transitional parts form an entire annular ridge, the transitional parts being located on said side of the plate plane at a predetermined distance from the plate plane, the distance from the top of the protrusion to the plate plane being greater than the distance from the lowest point of the transitional part to the plate plane, and wherein the distance from the lowest point of the transitional part to the plate plane is greater than zero;

wherein the transitional part includes a first surface facing away from the plate plane and a second surface facing the plate plane.

2. The heat exchange plate for a plate heat exchanger as claimed in claim 1, wherein the top of the protrusion is substantially flat.

3. The heat exchange plate for a plate heat exchanger as claimed in claim 1, wherein the distance from the top of the protrusion to the lowest point of the transitional part is less than or equal to the distance from the lowest point of the transitional part to the plate plane.

4. The heat exchange plate for a plate heat exchanger as claimed in claim 1, wherein the dimension of the top of the protrusion in the circumferential direction of the annular line is greater than a radial dimension.

5. The heat exchange plate for a plate heat exchanger as claimed in claim 1, wherein the top of the protrusion is an elongated part extending in the circumferential direction of the annular line.

6. The heat exchange plate for a plate heat exchanger as claimed in claim 1, wherein the transitional parts have the shape of a curved surface.

7. The heat exchange plate for a plate heat exchanger as claimed in claim 1, wherein the transitional parts project to another side, opposite said side, of the plate plane, relative to the tops of adjacent protrusions.

8. The heat exchange plate for a plate heat exchanger as claimed in claim 1, wherein the protrusions are connected via corresponding transitional parts, and together with the transitional parts form an entire annular ridge.

9. The heat exchange plate for a plate heat exchanger as claimed in claim 1, wherein a protrusion or protrusions in at least a first region differ(s) in size, shape and/or spacing from a protrusion or protrusions in a second region.

10. The heat exchange plate for a plate heat exchanger as claimed in claim 1, also comprising: a channel ridge which extends from at least one protrusion in a direction away from the opening and is used for forming a fluid channel.

11. The heat exchange plate for a plate heat exchanger as claimed in claim 10, wherein the top of the at least one protrusion and the top of the channel ridge are substantially in the same plane.

12. A plate heat exchanger, comprising: the heat exchange plate for a plate heat exchanger as claimed in claim 1.

13. The heat exchange plate for a plate heat exchanger as claimed in claim 2, wherein the dimension of the top of the protrusion in the circumferential direction of the annular line is greater than a radial dimension.

14. The heat exchange plate for a plate heat exchanger as claimed in claim 2, wherein the top of the protrusion is an elongated part extending in the circumferential direction of the annular line.

15. The heat exchange plate for a plate heat exchanger as claimed in claim 6, wherein the transitional parts project to another side, opposite said side, of the plate plane, relative to the tops of adjacent protrusions.

16. A heat exchange plate for a plate heat exchanger, the heat exchange plate comprising:

a plate part including an opening for forming a port, the plate part defining a plate plane; and a protrusion part connected to the plate part;

wherein the plate part and the protrusion part together delimit a hollow space;

wherein the protrusion part includes protrusions arranged annularly around the opening, the protrusions extending away from the plate plane;

wherein the protrusion part includes a transitional part disposed annularly between two adjacent protrusions, wherein the protrusions are connected via corresponding transitional parts, and together with the transitional parts form an entire annular ridge, the transitional part extending toward the plate plane and being disposed at a predetermined distance from the plate plane, and wherein the distance from the lowest point of the transitional part to the plate plane is greater than zero;

wherein the transitional part includes a first surface facing away from the plate plane and a second surface facing the plate plane.

17. The heat exchange plate for a plate heat exchanger as claimed in claim 1, wherein the multiple protrusions and the transitional parts form a raised pattern, and wherein the raised pattern comprises an edge continuously surrounding the opening at the plate plane.

* * * * *